US007415785B1

(12) United States Patent
Morgan

(10) Patent No.: US 7,415,785 B1
(45) Date of Patent: Aug. 26, 2008

(54) CRAFT HOOP LAP STAND

(76) Inventor: Robert Elliott Morgan, 10025 Highway BB, Hillsboro, MO (US) 63050

( * ) Notice: Subject to any disclaimer, the term of this patent is extended or adjusted under 35 U.S.C. 154(b) by 0 days.

(21) Appl. No.: 11/470,890

(22) Filed: Sep. 7, 2006

(51) Int. Cl.
*D05C 1/04* (2006.01)
*D05B 97/00* (2006.01)

(52) U.S. Cl. ..... 38/102.2

(58) Field of Classification Search ..... 38/102.91, 38/102.2, 102, 102.1, 102.21, 102.9; 269/3, 269/55, 289 R
See application file for complete search history.

(56) References Cited

U.S. PATENT DOCUMENTS 406,119 A * 7/1889 White ..... 38/102.2
699,263 A * 5/1902 Vosler ..... 38/102.2
3,098,280 A * 7/1963 Harris et al. ..... 38/102.4
3,309,803 A * 3/1967 Wilson ..... 38/102.2
3,750,312 A * 8/1973 Bucher ..... 38/102.2
3,906,648 A * 9/1975 Bard ..... 38/102.2
4,660,814 A * 4/1987 Shader et al. ..... 269/16
5,287,640 A 2/1994 Morgan
5,330,143 A 7/1994 Rich et al.
5,555,653 A 9/1996 Morgan
5,722,191 A 3/1998 Morgan
6,158,153 A 12/2000 Morgan

* cited by examiner

*Primary Examiner*—Ismael Izaguirre
(74) *Attorney, Agent, or Firm*—Erickson & Kleypas, L.L.C.

(57) ABSTRACT

A lap stand for supporting a craft frame or hoop upon a user's lap such that the hoop may be swiveled upon a universal joint in a variety of orientations to allow improved user access to the work piece held by the hoop.

6 Claims, 4 Drawing Sheets

CRAFT HOOP LAP STAND

BACKGROUND OF THE INVENTION

1. Field of the Invention

The present invention relates generally to improvements to a craft stand, and particularly to a craft stand provided with a bracket to secure the stand in a position proximate to the user's lap while the user is in a sitting position. More particularly, the present invention relates to a craft stand mounted on a swivel base attachable to various bracket configurations for supporting the craft stand upon a user's lap. Still more particularly, the present invention relates to a craft stand having a base plate or platen mounted upon a universal joint and with means for engaging legs depending from a craft hoop.

2. Description of the Related Art

Craft hoop assemblies generally include two concentric hoops or rings (an inner hoop and an outer hoop) for holding material such as fabric in a taut position over a center opening so that craft work, such as stitching with needle and thread, may readily be performed. Typically, the inner hoop has a fixed diameter and the outer hoop has an adjustable diameter. Material upon which work is to be performed is placed across the inner hoop. The outer hoop is then placed over the material and around the inner hoop. The diameter of the outer hoop is then reduced, typically by tightening a clamping mechanism associated with the outer hoop, such that the outer hoop fits snugly against the material and inner hoop so as to hold the material between the two hoops.

A variety of stands have previously been developed for supporting work pieces or craft frames, such as stretcher frames, embroidery hoops and the like, in predetermined positions. These stands generally allow a user to support the work piece or craft frame on the stand so that the user has both hands available to perform the desired craft. In addition, it is often preferable for the user to work in a sitting position with the work piece upon or proximate the user's lap.

The means used for supporting various work pieces and craft frames on a craft stand should be versatile enough to support, hold or secure various types and sizes of work pieces and frames. The means for supporting these work pieces and frames should also allow the work piece or frame to be supported in the user's lap and in a wide range of orientations. In addition, the means for supporting the work pieces and frames must function to securely hold the work piece or frame while in use and in a variety of positions without damaging the materials of the work piece and of the craft, and without causing fatigue to the user.

While performing craft work on material secured between the rings of a craft hoop, it is often necessary for the user to access the space below, as well as the space above, the material held between the rings for manipulation of a needle relative thereto, e.g. as with cross stitching or needlepoint. Having to constantly maneuver the craft hoop while performing the craft work to gain the appropriate access can be tiresome. Therefore, a craft stand should be provided with open sides to allow access to the space below the craft hoop. Many previous stands were limited in the ability to position the work piece proximate to a user's lap and were further limited in the ability to position the work piece in a wide range of orientations.

Various craft hoops are disclosed in U.S. Pat. Nos. 6,158,153; 5,722,191; 5,555,653 and 5,287,640; and a craft stand is disclosed in U.S. Pat. No. 5,330,143.

SUMMARY OF THE INVENTION

The purpose of this invention is to provide a lap stand for supporting a wide range of craft materials and sizes of frames upon or proximate a user's lap and in a wide range of orientations. The improved lap stand includes a craft hoop and base plate joined to one another with rods or legs to form an opened-sided craft stand subassembly. The base plate can be a flat, relatively solid plate, or can include relatively large cut outs or apertures to reduce the weight of the base plate. Both the craft hoop and the base plate are typically provided with receiving holes or bores for receiving the ends of the legs that join the craft hoop to the base plate, unless other means for attaching the legs are employed.

Bores of various distances from the center of the base plate may be provided so that legs depending from craft hoops of various diameters can be attached to the base plate. The bores may be round but alternatively may be square, triangular or otherwise polygonal, particularly if the legs are provided with matching polygonal ends that are inserted into the holes directly. By providing a multi-sided receiving hole for each similarly multi-sided leg to engage, the legs are prevented from turning within the holes when the craft hoop is turned, thereby maintaining the spatial relationship of the craft hoop to the base plate. Alternatively, screws may thread through smaller holes in the base plate and craft hoop and then into the ends of each support leg.

To allow the craft stand to be supported in a wide range of orientations, the lower surface of the base plate may be attached to a universal joint, such as a ball and socket, that further attaches to a lap stand bracket. A swivel device such as disclosed in U.S. Pat. No. 5,330,143 may be attached to the base plate to allow for tilt and rotation of the craft stand when the lap stand is sitting on the user's lap. Various embodiments of a lap bracket may be connected to the swivel device to allow the lap stand to either straddle the user's legs, be secured between the user's legs, or provide means for the user to sit upon a portion of the bracket, thereby applying leg pressure to the bracket to secure and stabilize the lap stand.

Other advantages of the invention will become apparent from the following description taken in connection with the accompanying drawings, wherein is set forth by way of illustration and example an embodiment of the present invention.

DETAILED DESCRIPTION

Figure 1:
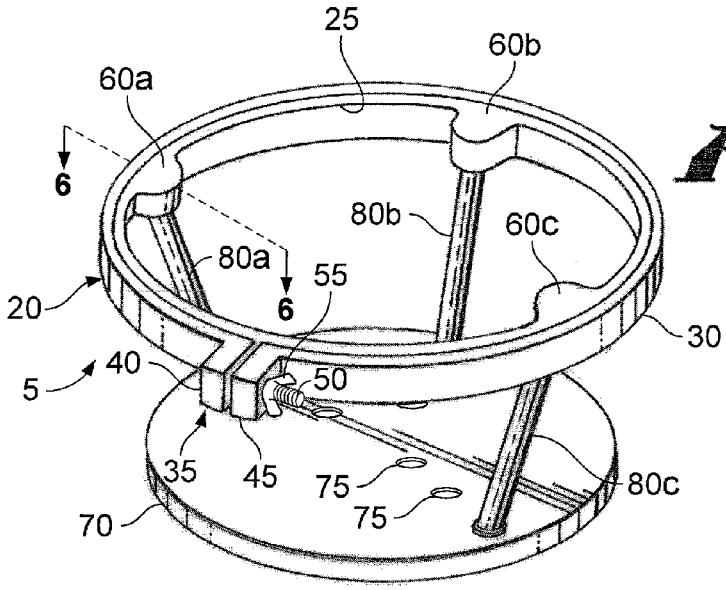
FIG. 1 is a perspective view of a craft stand subassembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In the drawings, similar numerical references indicate corresponding parts.

Referring now to FIGS. 1 through 7, the reference numeral 1 generally designates a lap stand for securing a work piece thereto. The lap stand includes a craft stand subassembly 5, a universal joint or swivel 10, and a lap bracket 15. The craft stand subassembly 5 (see FIG. 1) includes a craft hoop 20 comprising an inner ring or hoop 25 and a split outer ring or hoop 30. In the preferred embodiment, the rings 25 and 30 are formed from plastic but is foreseeable that the rings 25 and 30 may be formed from a wide variety of materials including wood, metal or other relatively rigid materials. The outer ring 30 of the craft hoop 20 includes clamping means such a clamp 35 for adjusting the diameter of the outer ring 30. The clamp 35 as shown comprises a pair of opposed ears 40 and 45, one ear mounted on one end of the split outer ring 30, and the other ear mounted on the other end of the split outer ring 30. The clamp 35 also includes a bolt 50 extending through coaxial apertures (not shown) in each ear 40 and 45 for threaded engagement with a nut 55. The outer ring 30 is sized such that the outer ring 30 may be positioned in encircling or circumscribing alignment with the inner ring 25. Tightening of the nut 55 on the bolt 50 urges the ears 40 and 45 and the ends of the outer ring 30 together so as to reduce the diameter of the outer ring 30 and to generally constrict the outer ring 30 around the inner ring 25.

Three protuberances or bosses 60*a*, 60*b* and 60*c* (referred to collectively by the numeral 60) are formed on, and extend inwardly from, the inner surface of the inner ring 25 of the craft hoop 20 in equally spaced apart relationship. A first leg-receiving bore 65 (first bore) is formed in and extends at least partially into each of the bosses 60 on the inner ring 25 of the craft hoop 20. The first bores 65 may be referred to individually as first bores 65*a*, 65*b* and 65*c*, with first bore 65*a* being formed in boss 60*a*, first bore 65*b* being formed in boss 60*b* and first bore 65*c* being formed in boss 60*c*. The first bores 65 extend into the bosses 60 from a lower surface 61 of the bosses 60 toward an upper surface 62 thereof. The first bores 65 may extend all the way through the bosses 60 to open at the upper surfaces 62 of the bosses 60 or may terminate prior to opening through the upper surfaces 62 (see FIGS. 3 and 6).

A base plate 70 is disposed below the craft hoop 20. The base plate 70 includes second leg receiving bores (second bores) 75*a*, 75*b* and 75*c* (referred to collectively by the numeral 75) formed therein, typically of a number equal to that of the first bores 65 (see FIGS. 2 and 3). In addition, the second bores 75 of the base plate 70 are in general radial alignment with, and generally disposed below, the first bores 65 of the craft hoop 20.

Three rods or legs 80*a*, 80*b* and 80*c* (referred to collectively by the numeral 80), each having first (upper) 85 and second (lower) 90 ends, are adapted for use in securing the craft hoop 20 and base plate 70 together. Each of the first ends 85 of the legs 80 are sized for insertion into one of the first leg receiving bores 65 for frictional engagement therein. Each of the second ends 90 of the legs 80 are sized for insertion into one of the second leg receiving bores 75 for frictional engagement therein.

Figure 2:
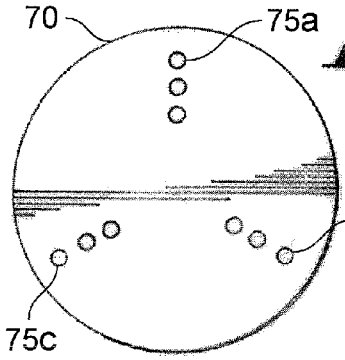
FIG. 2 is a top plan view of a base plate.

The craft stand subassembly 5 is formed, therefore, by attaching the craft hoop 20 to the base plate 70 by securing the upper ends 85 of the legs 80 in first bores 65 and the lower ends 90 in radially aligned, underlying, second bores 75, as illustrated in FIG. 1. As shown in FIG. 2, the base plate 70 may include multiple sets of holes 75. In the illustrated embodiment, each set comprises three holes 75*a*, 75*b* and 75*c* equidistant from one another and from the center of the base plate 70. Further sets of holes are disposed inward from the first set 75*a*, 75*b* and 75*c* and may be in radial alignment with other sets, as shown, or may deviate from radial alignment. FIG. 1 illustrates legs 80 extending downward from the craft hoop 20 to engage the outermost set of holes 75*a*, 75*b* and 75*c* in the base plate 70. It should be appreciated that a craft hoop 20 of reduced diameter could be attached to the base plate 70 by attaching the lower portion 90 of the legs 80 thereof to an inward set of holes 75.

Figure 6:
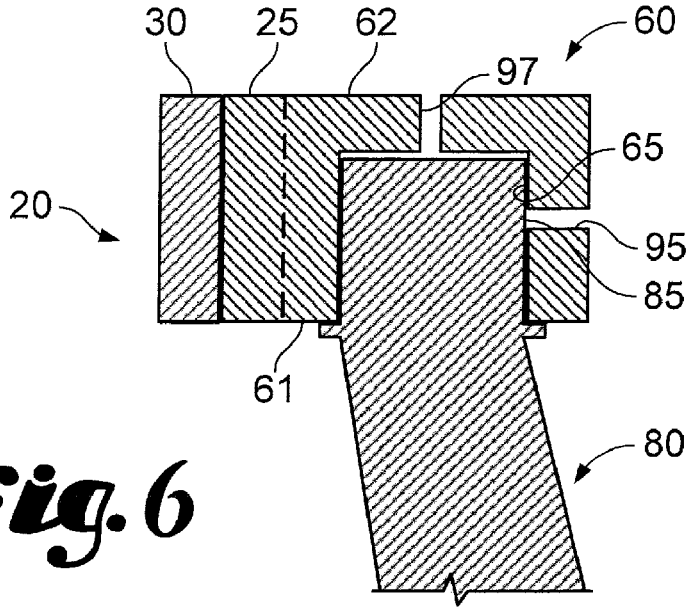
FIG. 6 is an enlarged, partial, cross sectional view of an upper portion of a leg inserted into a craft hoop boss taken along line 6-6 in FIG. 1.

The legs 80 may be more securely attached to either the craft hoop 20 or the base plate 70 using set screws threaded through holes 95 in the side of the craft hoop 20 or base plate 70, or through holes 97 in the top surfaces 62 of the bosses 60 or the bottom surface 72 of the base plate 70 proximate to the second bores 75 (see FIG. 6). For example, with reference to FIGS. 3 and 6, the bosses 60 are provided with leg receiving bores 65 that protrude upward from the lower surface 61 of the boss 60 stopping short of emergence through the top surface 62 of the boss 60. A smaller hole 97 may then be provided through that top surface 62 in axial alignment with the center of the associated bore 65, for receiving screws (not shown) that may then be threaded through these smaller holes 97 in each boss 60 and into the upper ends 85 of the legs 80 within the bores 65. Alternatively, a small hole 95 may be provided in the side of the boss 60 for receiving a set screw (not shown).

Similarly, the base plate 70 may be provided with leg receiving bores 75 that protrude downward from the top surface 74 of the base plate 70 stopping short of emergence through the bottom surface 72 of the base plate 70. A smaller hole (not shown) may then be provided through that bottom surface 72, typically in axial alignment with the center of the associated bore 75, for receiving screws (not shown) that are then be threaded through these smaller holes and into the lower ends 90 of the legs 80 within the bores 75.

Figure 3:
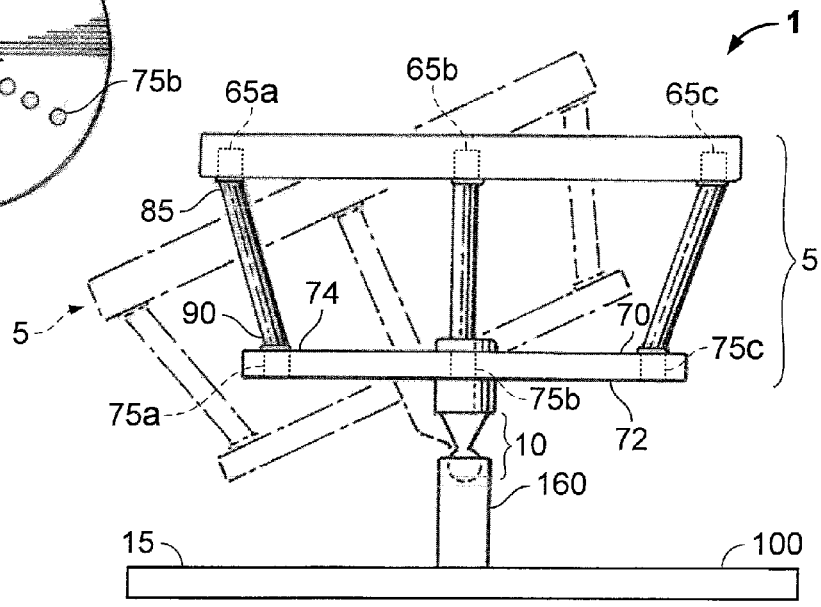
FIG. 3 is a side view of a lap stand with the craft stand subassembly shown in an upright position in solid lines and tilted leftward in phantom lines.
Figure 7:
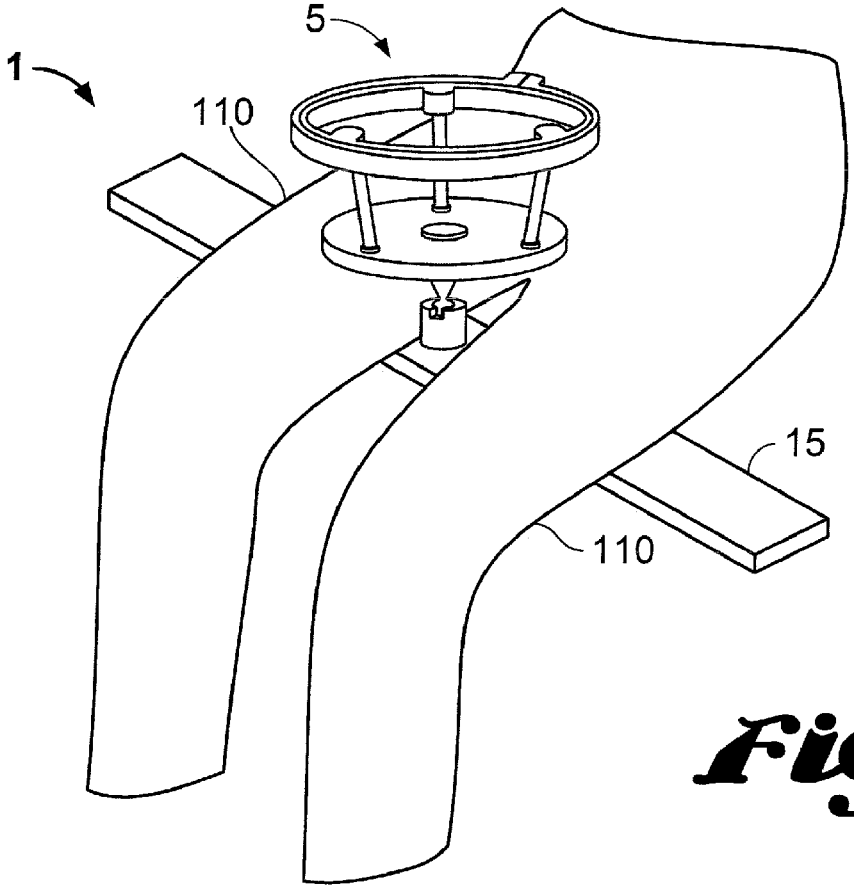
FIG. 7 is a diagram showing the legs of a user straddling the lap bracket of the lap stand of FIG. 3.

The lap stand 1 is stabilized for use through employment of a lap bracket 15 that is connected to the base plate 70 by the universal joint 10, which will be described in greater detail below. The lap bracket 15 includes an elongated, generally horizontal arm 100 for attachment to, and to support, the universal joint or swivel mechanism 10. In certain embodiments, the arm 100 may substantially comprise the bracket 15. For example, FIGS. 3 and 7 illustrate a lap stand 1 that is designed to be held in place through placement of the user's legs 110 over the horizontal arm 100, one leg 110 on either side of the swivel 10, to straddle the lap stand 1 and hold it firmly in position during craft work and manipulation of the craft stand subassembly 5 about the universal joint 10. The various embodiments of the lap bracket 15 disclosed herein, or their equivalents, may be formed of any sufficiently rigid material such as metal or, preferably, plastic.

Figure 4:
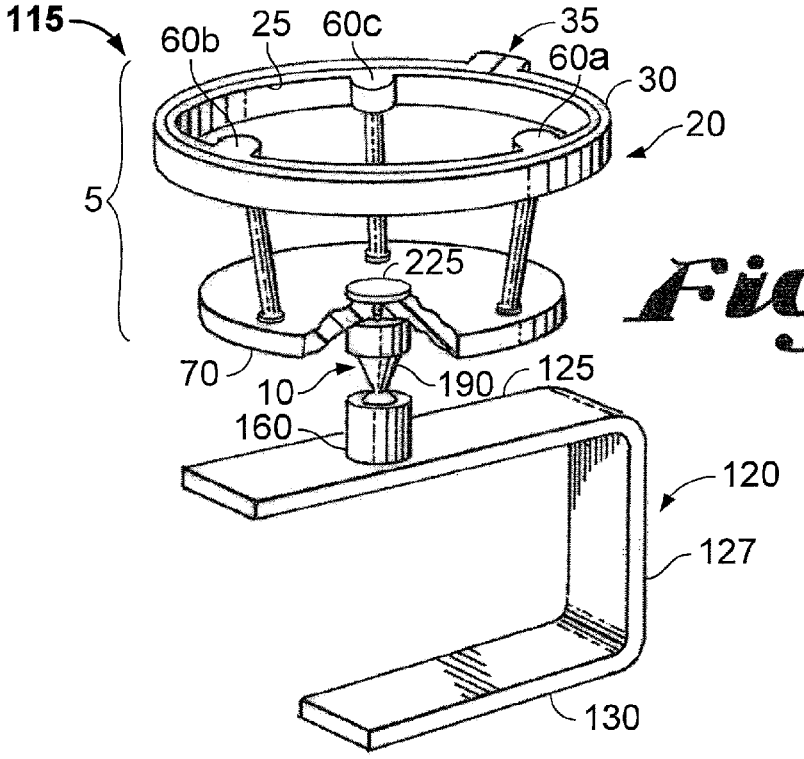
FIG. 4 is a perspective view of a lap stand showing an alternative embodiment of a lap bracket.

In an alternative embodiment of the lap bracket 15, shown in FIG. 4 and designated as lap bracket 120, one end of the upper horizontal arm 125 bends downward to form a vertical support 127 that extends downward for a distance that approximates the width of a user's leg 110 and then bends and extends laterally to underlie the upper arm 125 and form a lower horizontal arm 130. In use, a user in a sitting position upon a bench or chair may grasp the lap stand 115, with the craft stand subassembly 5 directed upward, and slide the upper arm 125 over one or both of the user's legs 110 while the lower arm 130 is slid underneath one or both of the user's legs 110. The lap stand 115 is then held in place by either the downward pressure of the user's leg 110 against the lower arm 130, pressing the lower arm 130 between the user's leg 110 and the bench or chair, or by slight compression or gripping of the user's leg 110 between the upper 125 and lower 130 arms, or by a combined effect of both means for stabilizing the lap stand 1.

Figure 5:
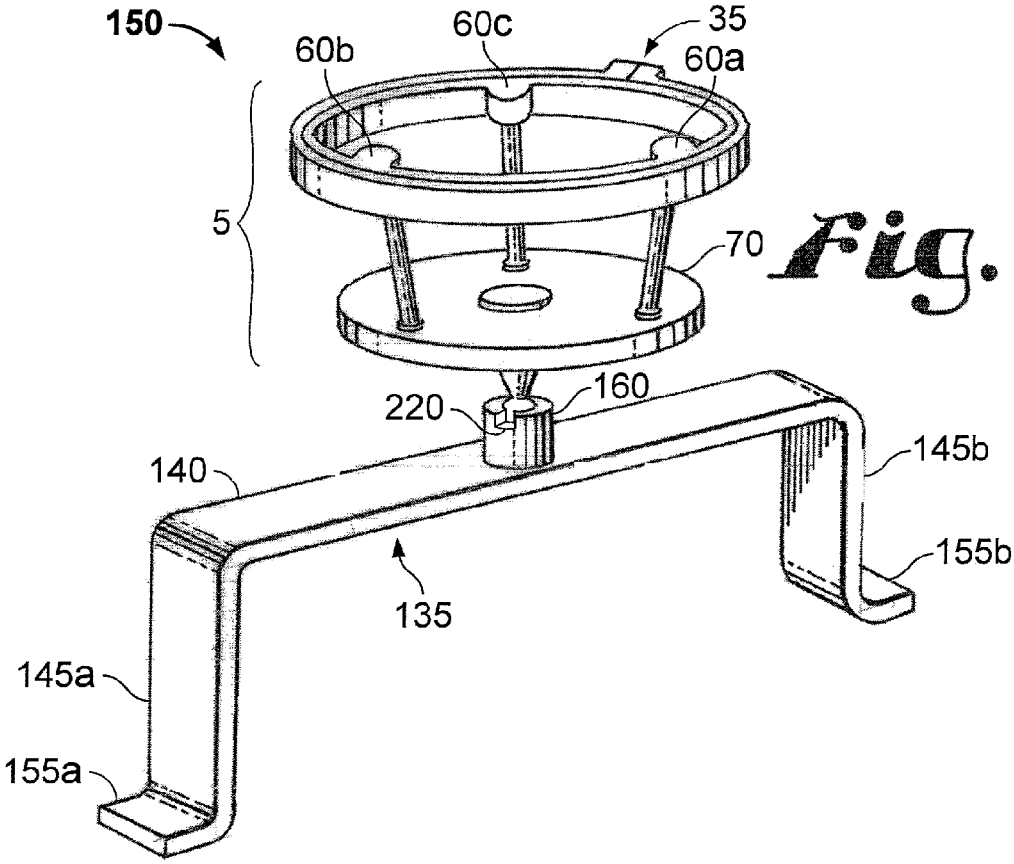
FIG. 5 is a perspective view of a lap stand showing a further alternative embodiment of a lap bracket.

A further alternative embodiment of the lap bracket 15, shown in FIG. 5 and designated as lap bracket 135, includes an upper arm 140 that extends laterally, approximately the width of a user's lap, and then bends downward at either end a distance approximating the vertical thickness of a user's leg 110 in order to provide vertical supports 145*a* and 145*b* that support the lap stand 150 against an underlying surface such as a bench or chair seat (not shown). In this embodiment, the upper arm 140 extends over the user's legs and may be supported by either the supports 145, the top surfaces of the user's legs 110, or both. As shown in FIG. 5, a foot 155*a*, 155*b* extends laterally outward from the lower portion of each support 145*a*, 145*b* to enhance the stability of the lap stand 150 upon the bench or seat.

Figure 8:
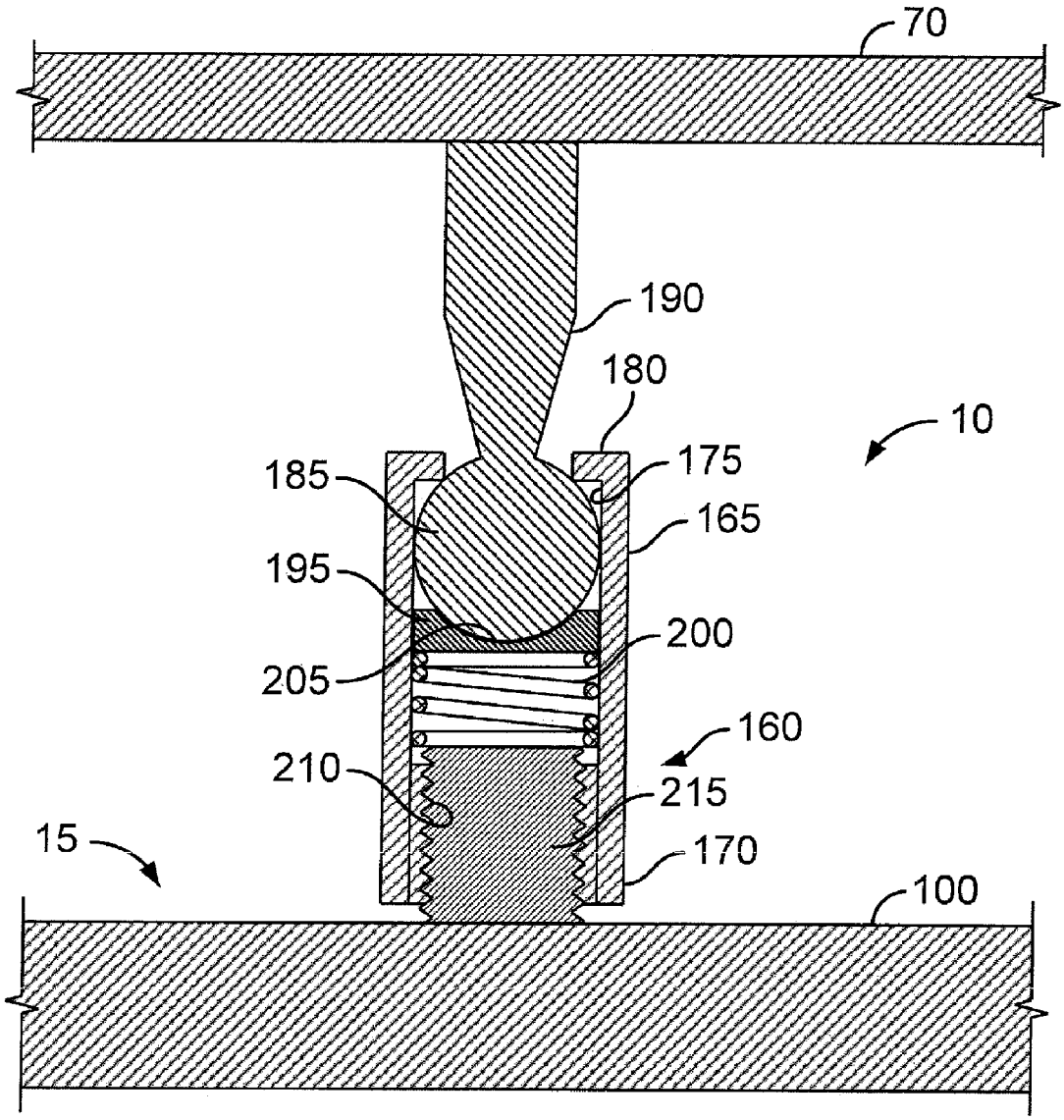
FIG. 8 is an enlarged cross sectional diagram of a universal joint.

The universal joint typically includes a ball or knob and cooperatively engaged socket such that the knob may turn within the socket. An appropriate universal joint assembly is disclosed in U.S. Pat. No. 5,330,143, and also, more generally, in the disclosure herein. The universal joint assembly 10 shown in FIGS. 3 to 5, and more particularly FIG. 8, includes a socket casing 160 with an upper end 165 and a lower end 170. A casing bore 175 extends through the casing 160 between its upper end 165 and lower end 170. A lip 180 restricts the diameter of the casing bore 175 adjacent to the casing upper end 165. The universal joint assembly 10 further comprises a knob or ball head 185 and an attached or integral shank 190 extending generally upward from the ball head 185. The ball head 185 is rotatably received within the casing bore 175 and restrained upwardly by the lip 180. The ball head 185 rotatably engages the inner margins of the lip 180 as well as an abutting lower surface such as a cup washer 195 pressed against the ball head 185 by a compression spring 200 held within the lower portion of the casing 160. The cup washer 195 has an upwardly open, generally semispherical depression 205 for receiving the ball head 185. The ball head 185 rotatably engages the cup washer 195 within this depression 205.

The lower portion of the bore 175 may include threads 210 for receiving a threaded plug 215. The lower portion of the plug 215 may be welded, screwed or otherwise attached to the arm 100 of the lap bracket 15. In use, the casing 160 is turned about the plug 215 to advance the plug 215 either upward or downward within the bore 175 of the casing 160 to increase or decrease compression of the spring 200 and concomitant pressure against the ball head 185. When the casing 160 is threadingly advanced downward relative to the plug 215, the upper end of the plug 215 urges the spring 200 and cup washer 195 upward so as to compress the ball head 185 between the cup washer 195 and the lip 180 thereby increasing resistance to rotation of the ball head 185 within the casing 160 and lock the ball head 185 in place in a selected position. Advancing the casing 160 upward reduces compression of the cup washer 195 against the ball head 185 and allows the ball head 185 to rotate in the casing 160.

The shank 190 extends above the lip 180 of the casing 160 and can rotate or pivot freely from vertical alignment to approximately 40 degrees from vertical. The upper end of the casing 165 may include a cut out portion or notch 220 (see FIG. 5) into which the shank 190 may be advanced so as to place the craft stand subassembly 5 in a generally horizontal position.

The upper portion of the shank 190 is attached to the base plate 70 through any effective means such as welding, integral molding with the base plate 70, or mechanical attachment such as screws or bolts. As shown in the cutaway in FIG. 4, a screw or bolt 225 may be advanced downward through a central aperture in the base plate 70 to further engage a threaded bore in the top portion of the shank 190.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A lap stand comprising: a craft hoop mounted to a base plate, said base plate secured by a universal joint assembly to a lap bracket adapted for engagement with a user's legs; said base plate having at least a first and second set of bores formed therein for engaging legs; extending from said craft hoop wherein said first set of bores are disposed radially outward from said second set of bores.

2. A lap stand comprising: a craft hoop mounted to a base plate, said base plate secured by a universal joint assembly to a lap bracket adapted for engagement with a user's legs wherein said lap bracket comprises an elongated, generally horizontal first arm, one or more generally vertical supports depending downward form said first arm, and wherein a lower horizontal second arm projects laterally from at least one of said supports to substantially underlie said first arm.

3. A lap stand comprising: an open sided craft stand comprising a craft hoop secured to a base plate, a universal joint assembly attached to said base plate, a bracket comprising a generally horizontal arm, said arm having a middle portion and opposite ends, each of said opposite ends extending downward to meet a support surface said arm connected to said universal joint assembly proximate to said middle portion and, wherein a foot extends generally horizontal from each of said opposing ends proximate to said support surface.

4. A lap stand comprising an open sided craft stand comprising a craft hoop secured to a base plate, a universal joint assembly attached to said base plate, a bracket comprising a generally horizontal upper arm, said upper arm having a middle portion and opposite ends, said upper arm connected to said universal joint assembly proximate to said middle portion, and wherein one end of said upper arm extends downward to meet a support surface, and further comprising a lower arm extending generally horizontal from said end to generally underlie said upper arm.

5. A lap stand comprising a craft hoop mounted to a base plate by at least three legs extending from said craft hoop, said base plate having at least first and second sets of at least three receivers formed therein, each receiver sized to receive an end of one of said legs extending from said craft hoop; wherein said first set of at least three receivers are disposed radially outward from said second set of at least three receivers.

6. The lap stand as in claim 5 wherein each of said receivers comprises a bore formed in said base plate.

* * * * *